United States Patent [19]

Yokomizo et al.

[11] 4,338,223

[45] Jul. 6, 1982

[54] METHOD OF MANUFACTURING A VOLTAGE-NONLINEAR RESISTOR

[75] Inventors: Yuji Yokomizo; Kiyoshi Minami, both of Nagai; Noboru Ichinose, Yokohama; Yoshikazu Tanno, Ayase, all of Japan

[73] Assignees: Marcon Electronics Co., Ltd., Nagai; Tokyo Shibaura Denki Kabushiki Kaisha, Kawasaki, both of Japan

[21] Appl. No.: 147,526

[22] Filed: May 7, 1980

[30] Foreign Application Priority Data

May 30, 1979 [JP] Japan ..... 54/66125
May 30, 1979 [JP] Japan ..... 54/66126
May 30, 1979 [JP] Japan ..... 54/66127
May 30, 1979 [JP] Japan ..... 54/66128

[51] Int. Cl.[3] ..... H01B 1/06

[52] U.S. Cl. ..... 252/519; 252/512; 252/518; 252/520; 252/521; 338/21; 29/610 R; 264/61

[58] Field of Search ..... 252/521, 520, 519, 518, 252/512; 264/61, 62, 63; 338/20, 21; 427/34, 250, 423; 29/610 R, 612, 619, 621

[56] References Cited

U.S. PATENT DOCUMENTS

| | | | |
|---|---|---|---|
| 3,962,144 | 6/1976 | Matswya et al. | 252/519 |
| 4,052,340 | 10/1977 | Eijnthorea et al. | 252/518 |
| 4,060,661 | 11/1977 | Takami et al. | 252/519 |
| 4,127,511 | 11/1978 | Klein | 252/519 |
| 4,142,996 | 3/1979 | Wong et al. | 252/518 |
| 4,254,070 | 3/1981 | Yodogaua et al. | 252/521 |
| 4,265,844 | 5/1981 | Yokomizo et al. | 252/519 X |

*Primary Examiner*—Joseph L. Schofer
*Assistant Examiner*—J. L. Barr
*Attorney, Agent, or Firm*—Oblon, Fisher, Spivak, McClelland & Maier

[57] ABSTRACT

A voltage-nonlinear resistor having a good polarity characteristics is manufactured by sintering a composition containing metal zinc, zinc oxide and at least one oxide selected from the group consisting of nickel oxide, zirconium oxide, yttrium oxide, hafnium oxide and scandium oxide, each component being contained in an amount within a specific range.

17 Claims, 7 Drawing Figures

METHOD OF MANUFACTURING A VOLTAGE-NONLINEAR RESISTOR

BACKGROUND OF THE INVENTION (1) Field of the Invention

This invention relates to a method of manufacturing a voltage-nonlinear resistor, and more particularly to a method of manufacturing such a resistor based on zinc oxide.

(2) Description of the Prior Art

Various semiconductor circuit elements are known. One of them is a voltage-nonlinear resistor, generally called "varistor". This element has a nonlinear voltage-current characteristic. That is, its resistance abruptly lowers as the voltages applied to it elevate, thus permitting current to increase sharply. It absorbs an abnormally high voltage or stabilizes voltage and is therefore used in electric circuits of various types.

Typical voltage-nonlinear resistors are an SiC varistor, Si varistor and a selenium varistor. Another typical voltage-nonlinear resistors are cuprous oxide- and zinc oxide-based sintered body varistors. An SiC varistor is formed by sintering SiC particles having a diameter of about 100$\mu$, using a ceramic binder. The SiC varistor can withstand a relatively high voltage. But it cannot be used as a low voltage element because it cannot be made sufficiently thin. An Si varistor is based on a p-n junction which is formed in a silicon substrate. It functions well as a low voltage element. Its use is, however, limited because its voltage-current characteristic cannot be adjusted freely. A selenium varistor and a cuprous oxide-based sintered body varistor exhibit their voltage-current characteristic at the junction of their surfaces with a metal layer and are disadvantageous in that their voltage-current characteristic cannot be controlled freely as in the Si varistor.

By contrast, ZnO-based sintered body varistors, particularly those containing, an impurities, $Bi_2O_3$, CoO and $Sb_2O_3$, each in an amount up to 10 mol %, have a voltage-current characteristic curve which is symmetrical with respect to the zero-volt axis. These varistors have a good voltage-current characteristic, which can be controlled by changing their thickness. For this advantageous point, ZnO-based sintered body varistors are attracting much attention. The known varistor of this type is, however, not fully satisfactory. Its voltage-current characteristic much varies particularly in negative direction due to external factors such as impulse current, D.C. load and temperature-humidity cycle.

SUMMARY OF THE INVENTION

Accordingly, it is an object of this invention to provide a method of manufacturing a voltage-nonlinear resistor which exhibits a symmetrical voltage-nonlinear characteristic and is stable and reliable.

Another object of this invention is to provide a method of manufacturing a ZnO-based sintered body varistor whose voltage-current characteristic is not varied so much in negative direction by external factors.

According to this invention a method of manufacturing a voltage-nonlinear resistor is provided, which comprises steps of:

providing a starting composition comprising 0.01 to 10 mol % of a first additive selected from the group consisting of nickel oxide and its precursor, 0.01 to 10 mol % of a second additive selected from the group consisting of zirconium oxide or its precursor, yttrium oxide or its precursor, hafnium oxide or its precursor, and scandium oxide or its precursor, 0.01 to 10 mol % of metal zinc and the remainder being zinc oxide; and sintering said starting composition to form a sintered body having a voltage-nonlinear resistance characteristic.

DETAILED DESCRIPTION OF THE PREFERRED EMBODIMENTS

Figure 1:
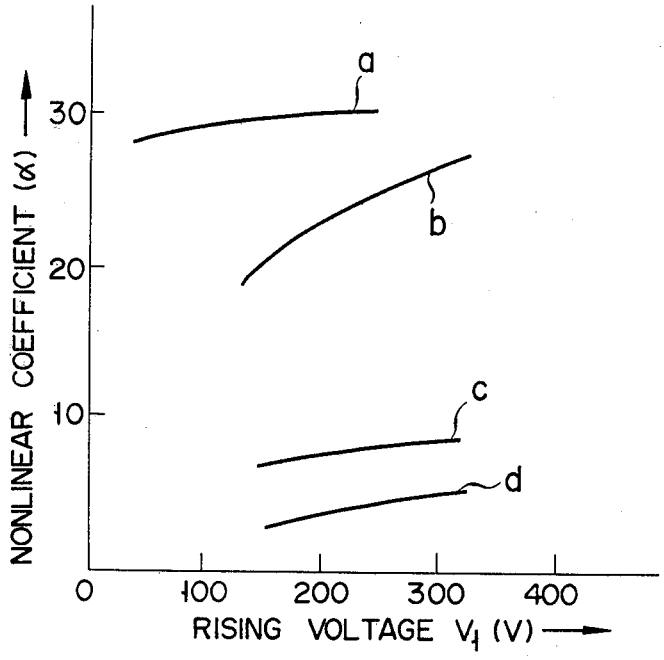
FIGS. 1 to 4 are graphs illustrating the characteristics of resistors prepared according to different embodiments of this invention and the characteristics of some controls.

The starting composition used in this invention and the conditions for sintering the composition will first be described in detail.

STARTING COMPOSITION

As mentioned above, the starting composition according to this invention contains two impurity additives. The first additive is nickel oxide (NiO). The second additive is selected from the group consisting of zirconium oxide ($ZrO_2$), yttrium oxide ($Y_2O_3$), hafnium oxide ($HfO_2$) and scandium oxide ($Sc_2O_3$). Each of the first and second impurity additives is used in an amount of 0.01 to 10 mol % based on the total amount of the composition. If the additives are used in an amount outside this specific range, a voltage-nonlinear resistor of a high reliability will not be obtained. Preferably, the first and second additives should be used each in an amount of 0.5 to 1 mol %.

Instead of the above-mentioned metal oxides, the precursors of the oxides may be used as the first and second additives in the same amount, i.e. 0.01 to 10 mol %. The term "precursor" means those compounds which can be converted into the corresponding metal oxides when they undergo sintering of such conditions as will later be described. Such precursors include metal carbonate, metal oxalate and the like.

The starting composition contains metal zinc (Zn) in addition to the above-mentioned first and second impurity additives and zinc oxide (ZnO). This is one of the features of the invention. Metal zinc will be converted into an oxide when the composition is sintered. It is used in an amount of 0.01 to 10 mol % based on the total amount of the composition. If its amount falls outside this range, a resistor of a high reliability will not be obtained. Preferably, metal zinc should be used in an amount of 3 to 6 mol %.

Moreover, the starting composition according to this invention may contain a rare earth element such as cerium (Ce) and praseodymium (Pr), in an amount up to 0.5 mol %. If the composition contain a rare earth element, the nonlinear characteristic of the resultant sintered body varistor is improved and, in addition, the resistance of the varistor can be controlled. The remainder of the starting composition is zinc oxide.

SINTERING CONDITIONS

To manufacture a varistor, using the above-mentioned starting composition, the components of the composition, which are in the form of powder, are thoroughly mixed. If necessary, a binder such as polyvinyl alcohol is added to the mixture and thoroughly mixed with the mixture. The mixture is then shaped under a predetermined pressure. The body of the mixture thus shaped is sintered generally in the air at a temperature of at least about 1,100° C. (usually not more than 1,200° C.), preferably at about 1,150° C. to 1,200° C., for approximately two to four hours. Usually the sintering is not conducted under pressure. The body may be thick or thin so as to have a desired voltage-current characteristic. The body thus sintered exhibits a symmetrical voltage-nonlinear characteristic which is very stable and highly reliable. Particularly, the sintered body will have its voltage-nonlinear characteristic varied very little in negative direction even when it is exposed to external factors such as impulse current, D.C. load and a temperature-humidity cycle.

The sintered body thus obtained is coated on both major surfaces with, for example, silver paste and then is heated so that the silver paste adheres to the body, thus forming electrodes. Alternatively, aluminum electrodes may be formed on the sintered body, either by spraying process or by vapor deposition. Now provided with electrodes, the sintered body makes a voltage-nonlinear resistor element having a high reliability.

This invention will be more fully understood from the following examples.

EXAMPLE 1

Various starting compositions were prepared. Each of them contained 3 mol % of metal zinc, 0.1 to 10 mol % of nickel oxide powder, 0.1 to 10 mol % of zirconium oxide powder and the remainder being zinc oxide powder. These components had been thoroughly mixed. The starting compositions were shaped to form discs which had a diameter of 20 mm and a thickness of 1 mm. These discs were sintered in the air at a temperature of at least 1,100° C. The discs sintered were coated on both surfaces with silver paste. The discs were then heated to make the silver paste film adhere to them, thus manufacturing voltage-nonlinear resistor elements.

The voltage-current characteristic of the resistor elements were determined by the following formula:

$$I=(V/C)^{\alpha},$$

where C is a coefficient, and $\alpha$ a nonlinear coefficient. The larger is $\alpha$, the better is the nonlinear characteristic.

The characteristic of a varistor can be represented by its coefficient $\alpha$, and voltage $V_1$ at 1 mA (i.e. rising voltage) instead of C. When the greatest $\alpha$ possible with $V_1$ of each resistor element was plotted, such a characteristic curve a as shown in FIG. 1 was obtained. Three controls were manufactured. The first control was made of a ($ZnO+NiO+ZrO_2$)-system composition which differed from the above-mentioned starting composition only in that zinc oxide replaced metal zinc. The second control was made of a ($ZnO+NiO$)-system composition which differed from the above-mentioned starting composition only in that zinc oxide replaced metal zinc and zirconium oxide. The third control was made of a ($ZnO+ZrO_2$)-system composition which differed from the above-mentioned starting composition only in that zinc oxide replaced metal zinc and nickel oxide. The first, second and third controls had such characteristic curves b, c and d as shown in FIG. 1.

EXAMPLE 2

Figure 2:
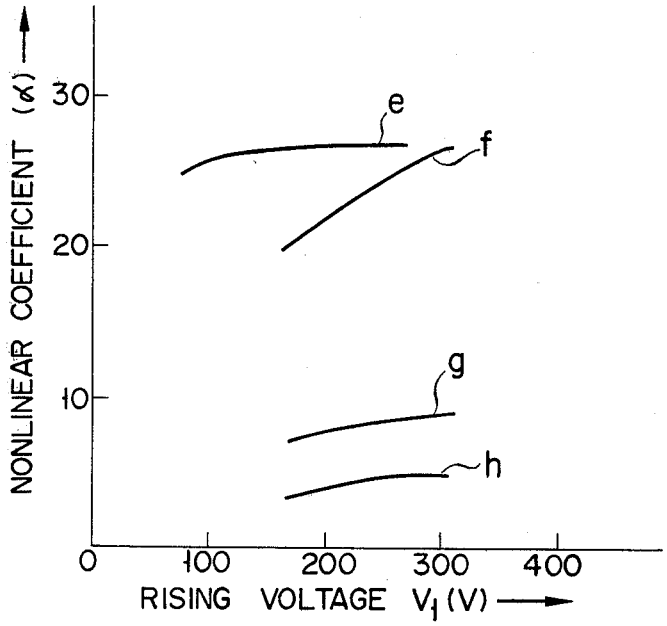

Several resistor elements were manufactured in the same way as those of Example 1, except that the starting composition contained yttrium oxide ($Y_2O_3$) instead of zirconium oxide ($ZrO_2$). These resistor elements exhibited such a voltage-nonlinear characteristic as indicated by curve e shown in FIG. 2. Curves f, g and h in FIG. 2 indicate the voltage-nonlinear characteristic of a control made of a ($ZnO+NiO+Y_2O_3$)-system composition, that of a control made of a ($ZnO+NiO$)-system composition and that of a control made of a ($ZnO+Y_2O_3$)-system composition, respectively.

EXAMPLE 3

Figure 3:
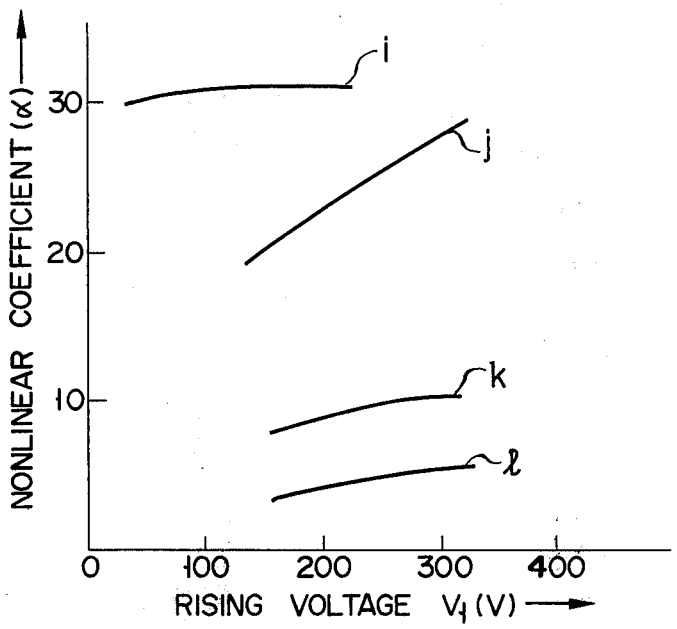

Several resistor elements were manufactured in the same way as those of Example 1, except that the starting composition contained hafnium oxide ($HfO_2$) instead of zirconium oxide ($ZrO_2$). The resistor elements exhibited such a voltage-nonlinear characteristic as indicated by curve i shown in FIG. 3. Curves j, k and l in FIG. 3 indicate the voltage-nonlinear characteristic of a control made of a ($ZnO+NiO+HfO_2$)-system composition, that of a control made of a ($ZnO+NiO$)-system composition and that of a control made of a ($ZnO+HfO_2$)-system composition, respectively.

EXAMPLE 4

Figure 4:
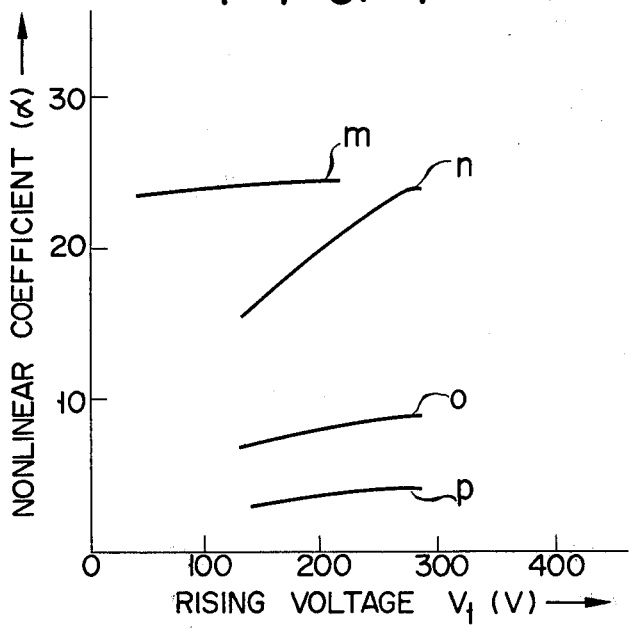

Several resistor elements were manufactured in the same way as those of Example 1, except that the starting composition contained scandium oxide ($Sc_2O_3$) instead of zirconium oxide ($ZrO_2$). These resistor elements exhibited such a voltage-nonlinear characteristic as indicated by curve m shown in FIG. 4. Curves n, o and p in FIG. 4 indicate the voltage-nonlinear characteristic of a control made of a ($ZnO+NiO+Sc_2O_3$)-system composition, that of a control made of a ($ZnO+NiO$)-system composition and that of a control made of a ($ZnO+Sc_2O_3$)-system composition, respectively.

As well understood from FIGS. 1 to 4, the varistors containing the same kind of additive manufactured by the method according to this invention had substantially the same varistor coefficient, whatever value may the voltage $V_1$ have. In contrast to them, the controls had their coefficients $\alpha$ varied according to the voltage $V_1$.

To demonstrate that the varistors manufactured by the method of this invention can have their voltage-current characteristic adjusted by changing their thickness, the following experiment or Examples 5 to 8 were made.

EXAMPLE 5

Several disc-shaped varistors, all having a diameter of 20 mm, some having a thickness of 0.5 mm, some others having a thickness of 1.0 mm and the others having a diameter of 2.0 mm, were manufactured in the same way as those of Example 1, except that use was made of a starting composition which consisted of 0.5 mol % of nickel oxide, 0.75 mol % of zirconium oxide, 4.0 mol % of metal zinc and the remainder being zinc oxide. Some of them were coated with silver paste and then heated to make the silver paste film adhere to them, thus forming electrodes. The others were provided with aluminum electrodes formed either by spraying process or by vapor deposition. All these varistors were tested, thereby measuring their voltage-nonlinear characteristics. The results were as shown in the following table:

TABLE 1

| Electrode fabrication | $V_1$(V) Thickness (mm) 0.5 | 1.0 | 2.0 | α Thickness (mm) 0.5 | 1.0 | 2.0 |
|---|---|---|---|---|---|---|
| Siver paste coating | 41 | 80 | 160 | 28 | 29 | 30 |
| Al-spraying | 43 | 82 | 162 | 28 | 28 | 29 |
| Al-vapor deposition | 42 | 81 | 161 | 28 | 28 | 29 |

EXAMPLE 6

Several disc-shaped varistors of the same size as those of Example 5 were manufactured in the same way as those of Example 5, except that yttrium oxide was used instead of zirconium oxide. These varistors were tested, thereby measuring their voltage-nonlinear characteristics. The results were as shown in the following table:

TABLE 2

| Electrode fabrication | $V_1$(V) Thickness (mm) 0.5 | 1.0 | 2.0 | α Thickness (mm) 0.5 | 1.0 | 2.0 |
|---|---|---|---|---|---|---|
| Silver paste coating | 48 | 94 | 188 | 28 | 28 | 27 |
| Al-spraying | 47 | 93 | 185 | 28 | 28 | 28 |
| Al-vapor deposition | 48 | 94 | 187 | 28 | 28 | 27 |

EXAMPLE 7

Several disc-shaped varistors of the same size as those of Example 5 were manufactured in the same way as those of Example 5, except that hafnium oxide was used instead of zirconium oxide. These varistors were tested, thereby measuring their voltage-nonlinear characteristics. The results were as shown in the following table:

TABLE 3

| Electrode fabrication | $V_1$(V) Thickness (mm) 0.5 | 1.0 | 2.0 | α Thickness (mm) 0.5 | 1.0 | 2.0 |
|---|---|---|---|---|---|---|
| Silver paste coating | 38 | 76 | 152 | 30 | 31 | 31 |
| Al-spraying | 39 | 78 | 155 | 29 | 30 | 30 |
| Al-vapor deposition | 39 | 76 | 153 | 30 | 31 | 30 |

EXAMPLE 8

Several disc-shaped varistors of the same size as those of Example 5 were manufactured in the same way as those of Example 5, except that scandium oxide was used instead of zirconium oxide. These varistors were tested, thereby measuring their voltage-nonlinear characteristics. The results were as shown in the following table:

TABLE 4

| Electrode fabrication | $V_1$(V) Thickness (mm) 0.5 | 1.0 | 2.0 | α Thickness (mm) 0.5 | 1.0 | 2.0 |
|---|---|---|---|---|---|---|
| Silver paste coating | 46 | 90 | 180 | 24 | 24 | 23 |

TABLE 4-continued

| Electrode fabrication | $V_1$(V) Thickness (mm) 0.5 | 1.0 | 2.0 | α Thickness (mm) 0.5 | 1.0 | 2.0 |
|---|---|---|---|---|---|---|
| Al-spraying | 46 | 92 | 183 | 24 | 23 | 23 |
| Al-vapor deposition | 45 | 91 | 182 | 24 | 24 | 23 |

To ascertain the polarity characteristics of the varistors manufactured by the method according to this invention, i.e. impulse current characteristic, D.C. load characteristic and temperature-humidity cycle characteristic, a number of varistors exhibiting $V_1$ of 200 V were formed of such various starting compositions as will be described in the following Examples 9 to 12.

EXAMPLE 9

Several varistors were manufactured, using a starting composition which consisted of 1.0 mol % of nickel oxide, 1.0 mol % of zirconium oxide, 3.0 mol % of metal zinc and the remainder being zinc oxide.

EXAMPLE 10

Several varistors were manufactured, using a starting composition which consisted of 0.5 mol % of nickel oxide, 0.75 mol % of yttrium oxide, 5.0 mol % of metal zinc and the remainder being zinc oxide.

EXAMPLE 11

Several varistors were manufactured, using a starting composition which consisted of 0.5 mol % of nickel oxide, 1.0 mol % of hafnium oxide, 4.0 mol % of metal zinc and the remainder being zinc oxide.

EXAMPLE 12

Several varistors were manufactured, using a starting composition which consisted of 0.75 mol % of nickel oxide, 1.0 mol % of scandium oxide, 3.5 mol % of metal zinc and the remainder being zinc oxide.

On the varistors of Examples 9 to 12 a surge current of 500A was applied 10,000 times, thus recording the impulse current characteristic of the individual varistor, i.e. variation of $V_1$ in positive and negative directions. On them a load of 2 watts were applied 500 times at 85° C., this recording the D.C. load characteristic of the individual varistor, i.e. variation of $V_1$ in positive and negative directions. Further, the ambient temperature of these varistors was changed from −40° C. to 88° C. exactly 100 times, while applying load of 2 watts on the varistors and maintaining the relative humidity at 95%, thereby recording the temperature-humidity cycle characteristic of the individual varistor, i.e. variation of $V_1$ in positive and negative directions. The results were as shown in the following Table 5, which also shows the polarity characteristics of a known varistor or control made of a composition consisting of 0.5 mol % of BiO, 0.5 mol % of MnO, 0.5 mol % of CoO, 1 mol % of $Sb_2O_3$ and the remainder being ZnO.

TABLE 5

| | Control | | Example 9 | | Example 10 | | Example 11 | | Example 12 | |
|---|---|---|---|---|---|---|---|---|---|---|
| | Positive direction | Negative direction | Positive direction | Negative direction | Positive direction | Negative direction | Positive direction | Negative direction | Positive direction | Negative direction |
| Temp.-humidity characteristic | +5% | −18% | +2.0% | −0.5% | +2.0% | −0.5% | +1.5% | −0.5% | +2.0% | −0.5% |
| D.C. load characteristic | +3% | −26% | +2.5% | −2.0% | +2.0% | −1.0% | +2.0% | −2.0% | +2.0% | −1.5% |
| Impulse current | | | | | | | | | | |

TABLE 5-continued

| | Control | | Example 9 | | Example 10 | | Example 11 | | Example 12 | |
|---|---|---|---|---|---|---|---|---|---|---|
| | Positive direction | Negative direction | Positive direction | Negative direction | Positive direction | Negative direction | Positive direction | Negative direction | Positive direction | Negative direction |
| characteristic | +4% | −20% | +2.0% | −1.5% | +1.5% | −1.0% | +1.5% | −1.5% | +1.5% | −1.5% |

As evident from Table 5, the starting voltage $V_1$ of the sintered, ZnO-based variators prepared according to this invention varies less in positive and negative direction than that of the known varistor. This much helps to maintain the symmetrical voltage-current characteristic of the varistors. Since its rising voltage $V_1$ varies but very little, the varistor of this invention has a long life and a high reliability.

Moreover, a number of varistors within the scope of this invention were manufactured, using various starting compositions and sintering the compositions at 1,200° C. for two hours. These varistors were put to test, thus recording their voltage-nonlinear characteristic ($V_1$, $\alpha$) and their impulse current characteristic, in the same way as the varistors of Examples 9 to 12 were tested. The results were as shown in the following Table 6, which also specifies the starting compositions used.

TABLE 6 (1)

| | | Starting composition (mol %) | | | | Voltage-nonlinearity | | Impulse current characteristic $\Delta V_1/V_1$ (%) | |
|---|---|---|---|---|---|---|---|---|---|
| | | ZnO | NiO | $MeO_x$ | Zn | $V_1$/mm | $\alpha$ | Positive direction | Negative direction |
| | | | | $Y_2O_3$ | | | | | |
| Example | 13 | 98.99 | 0.5 | 0.5 | 0.01 | 113 | 24 | +4 | −4 |
| | 14 | 98.9 | " | " | 0.1 | 108 | 26 | +3 | −2.5 |
| | 15 | 98 | " | " | 1 | 102 | 28 | +2 | −1 |
| | 16 | 89 | " | " | 10 | 87 | 25 | +2 | −2 |
| | | | | $Sc_2O_3$ | | | | | |
| | 17 | 98.99 | 0.5 | 0.5 | 0.01 | 109 | 21 | +5 | −4.5 |
| | 18 | 98.9 | " | " | 0.1 | 100 | 22 | +4 | −3 |
| | 19 | 98 | " | " | 1 | 92 | 24 | +2 | −1 |
| | 20 | 89 | " | " | 10 | 84 | 22 | +2 | −1.5 |
| | | | | $ZrO_2$ | | | | | |
| | 21 | 98.99 | 0.5 | 0.5 | 0.01 | 97 | 25 | +4 | −3.5 |
| | 22 | 98.9 | " | " | 0.1 | 90 | 26 | +3 | −2 |
| | 23 | 98 | " | " | 1 | 82 | 28 | +2 | −1 |
| | 24 | 89 | " | " | 10 | 75 | 26 | +2 | −2 |
| | | | | $HfO_2$ | | | | | |
| | 25 | 98.99 | 0.5 | 0.5 | 0.01 | 91 | 27 | +3 | −3 |
| | 26 | 98.9 | " | " | 0.1 | 85 | 28 | +3 | −1.5 |
| | 27 | 98 | " | " | 1 | 78 | 30 | +2 | −1 |
| | 28 | 89 | " | " | 10 | 71 | 26 | +2 | −2 |
| Control | 1 | 98.999 | 0.5 | $Y_2O_3$ = 0.5 | 0.001 | 154 | 18 | +4 | −9 |
| Control | 2 | 84 | 0.5 | $Sc_2O_3$ = 0.5 | 15 | 71 | 19 | +3 | −7 |

TABLE 6 (2)

| | Starting composition (mol %) | | | | Voltage-nonlinearity | | Impulse current characteristic $\Delta V_1/V_1$ (%) | |
|---|---|---|---|---|---|---|---|---|
| | ZnO | NiO | $MeO_x$ | Zn | $V_1$/mm | $\alpha$ | Positive direction | Negative direction |
| Example 29 | 99.48 | 0.01 | $Y_2O_3$ = 0.1<br>$Sc_2O_3$ = 0.4 | 0.01 | 110 | 23 | +4 | −4.5 |
| 30 | 98.9 | 0.1 | $Y_2O_3$ = 0.4<br>$ZrO_2$ = 0.1 | 0.5 | 104 | 25 | +3 | −4 |
| 31 | 98 | 0.5 | $Y_2O_3$ = 0.4<br>$HfO_2$ = 0.1 | 1 | 92 | 28 | +3 | −1.0 |
| 32 | 95.5 | 0.5 | $Sc_2O_3$ = 0.5<br>$ZrO_2$ = 0.5 | 3 | 87 | 31 | +2 | −0.5 |
| 33 | 93.5 | 1.0 | $ZrO_2$ = 0.5<br>$Hf_2O_3$ = 0.5<br>$Sc_2O_3$ = 0.01 | 5 | 81 | 30 | +2 | −0.5 |
| 34 | 95.89 | 0.5 | $Y_2O_3$ = 0.1<br>$ZrO_2$ = 0.5<br>$Y_2O_3$ = 0.5 | 3 | 108 | 30 | +3 | −3 |
| 35 | 91.5 | 1.0 | $Sc_2O_3$ = 1.0<br>$HfO_2$ = 1.0<br>$Y_2O_3$ = 1.0 | 5 | 97 | 31 | +3 | −1.5 |
| 36 | 85 | 3 | $ZrO_2$ = 3.0<br>$HfO_2$ = 3.0<br>$Sc_2O_3$ = 1.0 | 5 | 113 | 29 | +3 | −2.0 |
| 37 | 81 | 5 | $ZrO_2$ = 3.0<br>$HfO_2$ = 5.0<br>$Y_2O_3$ = 1 | 5 | 125 | 28 | +3 | −2.5 |

TABLE 6 (2)-continued

| | Starting composition (mol %) | | | | Voltage-nonlinearity | | Impulse current characteristic $\Delta V_1/V_1$ (%) | |
|---|---|---|---|---|---|---|---|---|
| | ZnO | NiO | $MeO_x$ | Zn | $V_1$/mm | α | Positive direction | Negative direction |
| 38 | 70 | 10 | $Sc_2O_3$ = 3<br>$ZrO_2$ = 3<br>$HfO_2$ = 3 | 10 | 145 | 27 | +3 | −3 |

What we claim is:

1. A method of manufacturing a voltage-nonlinear resistor comprising:

providing a starting composition comprising 0.01 to 10 mol % of a first additive selected from the group consisting of nickel oxide and its precursor, 0.01 to 10 mol % of a second additive selected from the group consisting of zirconium oxide or its precursor, yttrium oxide or its precursor, hafnium oxide or its precursor, and scandium oxide or its precursor, 0.01 to 10 mol % of metal zinc and the remainder being zinc oxide;

shaping said starting composition to provide a desired molded body;

sintering said starting composition at a temperature of at least about 1,100° C. to form a sintered body having a voltage-nonlinear resistance characteristic; and providing said sintered body with electrodes on both major surfaces.

2. A method according to claim 1, wherein said first additive is contained in the starting composition in an amount of 0.5 to 1 mol %.

3. A method according to claim 1, wherein said second additive is contained in the starting composition in an amount of 0.5 to 1 mol %.

4. A method according to claim 1 or 3, wherein said second additive is zirconium oxide or a precursor thereof.

5. A method according to claim 1 or 3, wherein said second additive is yttrium oxide or a precursor thereof.

6. A method according to claim 1 or 3, wherein said second additive is hafnium oxide or a precursor thereof.

7. A method according to claim 1 or 3, wherein said second additive is scandium oxide or a precursor thereof.

8. A method according to claim 1, wherein metal zinc is contained in the starting composition in an amount of 3 to 6 mol %.

9. A method according to claim 1, wherein said starting composition contains cerium or praseodymium in an amount up to 0.5 mol %.

10. A method according to claim 1, wherein said starting composition is sintered to about 1,150° C. to 1,200° C.

11. A method according to claim 10, wherein said starting composition is sintered for 2 to 4 hours.

12. A method according to claim 11, wherein said starting composition is sintered in the air.

13. A voltage-nonlinear resistor manufactured by the method according to any one of claims 1 to 3, 8, 9, 10, to 12.

14. A voltage-nonlinear resistor manufactured by the method according to claim 4.

15. A voltage-nonlinear resistor manufactured by the method according to claim 5.

16. A voltage-nonlinear resistor manufactured by the method according to claim 6.

17. A voltage-nonlinear resistor manufactured by the method according to claim 7.

* * * * *